United States Patent [19]

Takayanagi et al.

[11] Patent Number: 4,684,239

[45] Date of Patent: Aug. 4, 1987

[54] IMAGE FORMING APPARATUS WITH AUTOMATIC REGULATION IN RESPONSE TO IMAGE DENSITY

[75] Inventors: Yoshiaki Takayanagi; Masato Ishida, both of Yokohama; Makoto Miura, Hino, all of Japan

[73] Assignee: Canon Kabushiki Kaisha, Tokyo, Japan

[21] Appl. No.: 766,406

[22] Filed: Aug. 16, 1985

[30] Foreign Application Priority Data

Aug. 22, 1984 [JP] Japan ..... 59-175569
Aug. 22, 1984 [JP] Japan ..... 59-175571
Aug. 22, 1984 [JP] Japan ..... 59-175572

[51] Int. Cl.[4] ..... G03G 15/00

[52] U.S. Cl. ..... 355/14 R; 355/3 R; 355/14 E

[58] Field of Search ..... 355/14 R, 14 E, 3 R; 118/688, 691, 712

[56] References Cited

U.S. PATENT DOCUMENTS

| | | | |
|---|---|---|---|
| 3,321,307 | 5/1967 | Urbach | 355/14 E X |
| 3,788,739 | 1/1974 | Coriale | 355/3 R X |
| 4,348,099 | 9/1982 | Fantozzi | 355/14 E |
| 4,502,277 | 3/1985 | Okamoto et al. | 355/14 R |
| 4,511,240 | 4/1985 | Suzuki et al. | 355/14 E X |

*Primary Examiner*—A. C. Prescott

*Attorney, Agent, or Firm*—Fitzpatrick, Cella, Harper & Scinto

[57] ABSTRACT

A copying machine in which image forming conditions such as developing bias voltage is automatically regulated in response to the detected image density of the original document and to the sensitivity characteristics of the photosensitive drum, in order to obtain an optimum copy image regardless of the change in the sensitivity of photosensitive drum.

18 Claims, 17 Drawing Figures

IMAGE FORMING APPARATUS WITH AUTOMATIC REGULATION IN RESPONSE TO IMAGE DENSITY

BACKGROUND OF THE INVENTION

1. Field of the Invention

The present invention relates to an image forming apparatus such as copying machine, and more particularly to such image forming apparatus capable of controlling the image forming conditions in response to the original image density to obtain an optimum copy image.

2. Description of the Prior Art

In the image forming apparatus such as copying machine, the adjustment of the copy image density has conventionally been achieved by varying the lighting voltage of an exposure lamp LA1, shown in FIG. 2, by means of a variable resistor VR1 linked to a knob 300 of an operation panel shown in FIG. 1.

However, such conventional method has often required several trial copying operations before an optimum image is obtained, thus leading to an unnecessary waste of copy sheets.

In order to avoid such drawback, there has recently been proposed a system in which the density of the original image is detected in advance and the amount of exposure is regulated according to thus detected image density.

However the sensitivity of a photosensitive drum employed in such image forming apparatus varies according to the number of copying cycles it has been subjected to, so that the control on the amount of exposure alone does not necessarily provide an optimum image density in the copy.

SUMMARY OF THE INVENTION

In consideration of the foregoing, an object of the present invention is to provide an improved image forming apparatus.

Another object of the present invention is to provide an image forming apparatus capable of constantly achieving adequate image formation in response to the original image density.

Still another object of the present invention is to provide an image forming apparatus capable of constantly achieving adequate image formation in response to the original image density, regardless of variation in the sensitivity characteristics of a recording member.

DETAILED DESCRIPTION OF THE PREFERED EMBODIMENTS

Now the present invention will be clarified in greater detail by embodiments thereof shown in the attached drawings.

Figure 1:
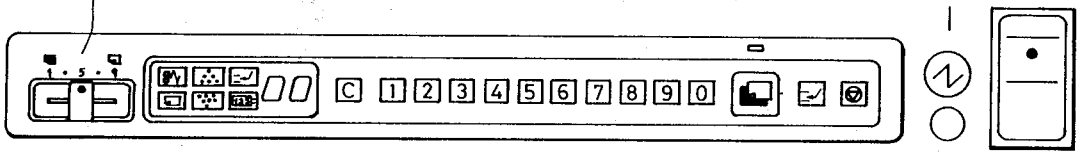
FIG. 1 is a schematic view of an operation unit of a copying machine.
Figure 2:
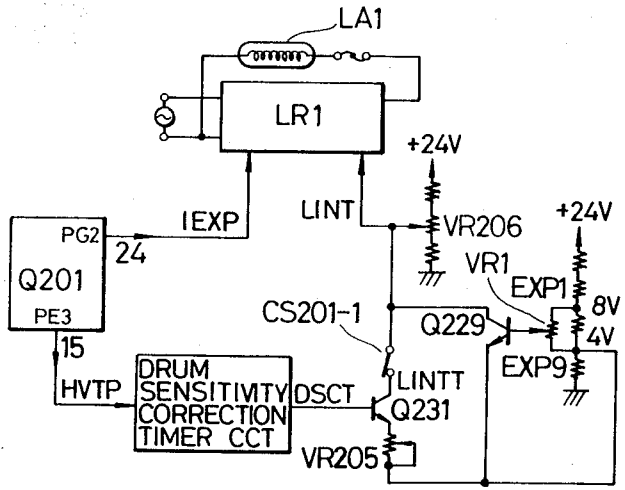
FIG. 2 is a circuit diagram showing a conventional density control circuit.
Figure 3:
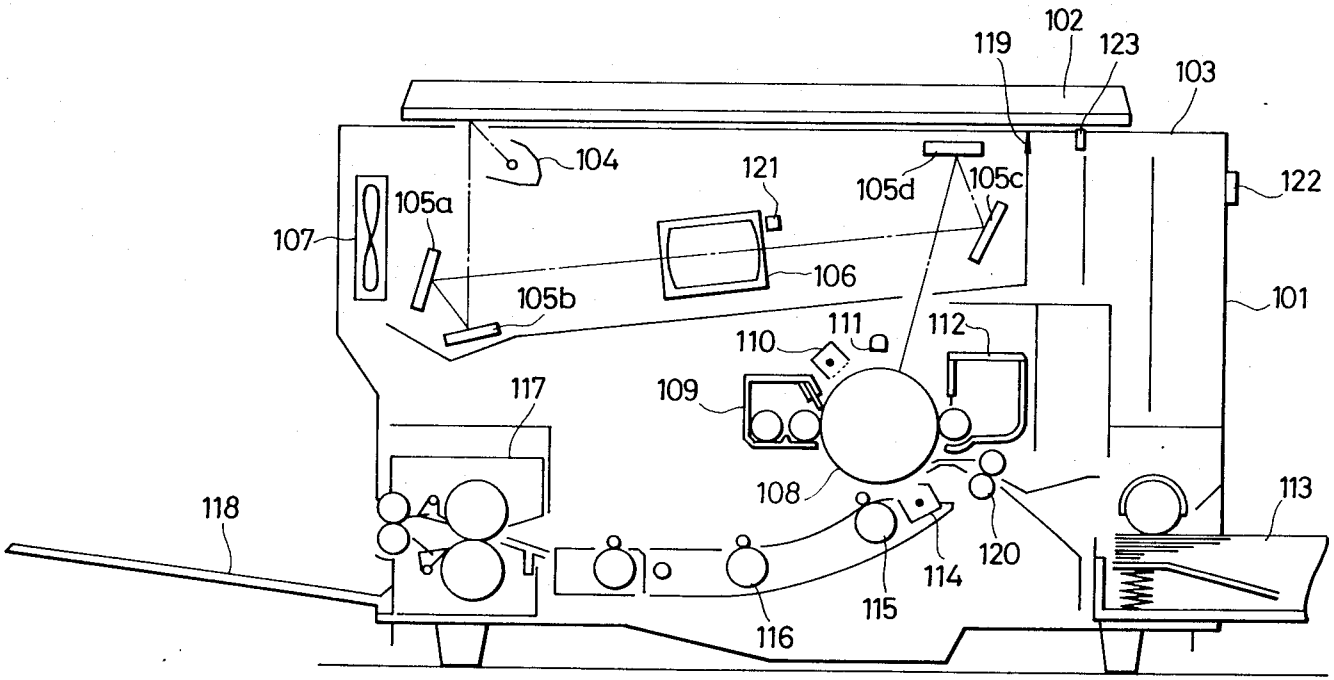
FIG. 3 is a cross-sectional view of a copying machine in which the present invention is applied.

FIG. 3 is a schematic cross-sectional view of a copying machine, representing an embodiment of the image forming apparatus of the present invention.

In FIG. 3 there are shown a main body 101; an original cover 102; an original support table 103 with an operation unit; an exposure lamp 104; mirrors 105*a*–105*d*; a zoom lens 106 for varying image magnification; an exhatst fan 107; a photosensitive drum 108; a cleaner 109 for removing toner remaining on the photosensitive drum 108; a charger 110 for uniformly charging the photosensitive drum 108 positively or negatively; a blank exposure lamp 111 for eliminating electrostatic charge in the non-image area on said photosensitive drum 108; a developing unit 112 for developing an electrostatic latent image formed on the photosensitive drum 108; a sheet cassette 113 housing copysheets; a transfer charger 114 for transferring a toner image from the photosensitive drum 108 onto a copy sheet; a separation roller 115; a conveyor roller 116; a fixing unit 117 for fixing the toner image transferred onto the copy sheet; a copy tray 118; an image front end sensor 119 for releasing a signal indicating the front end of an original; a registration roller 120; a photosensor 121 for detecting the intensity of the light reflected from the original in order to measure the density thereof; a power switch 122; and a home position sensor 123. In this copier, the original image is scanned by reciprocating motion of the original support table. The copying process employed therein is already known in the prior art and will not therefore be explained in detail.

Figure 4:
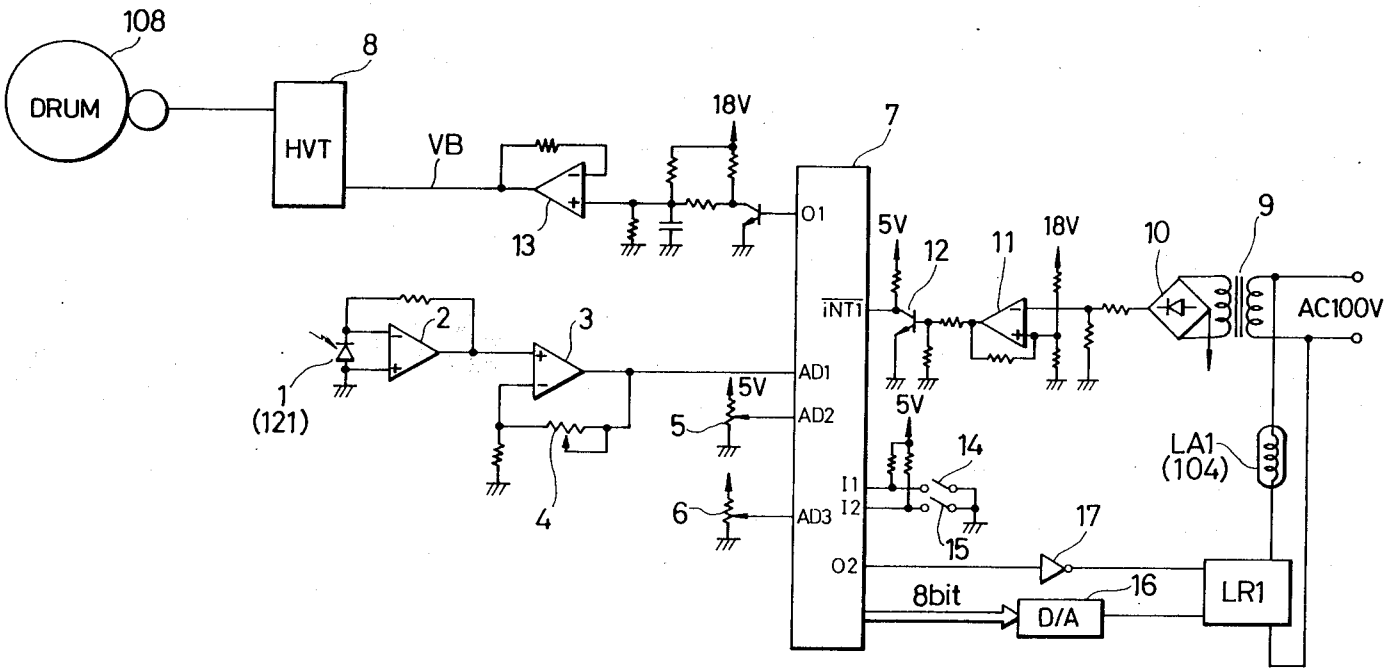
FIG. 4 is a circuit diagram of an original image density detecting circuit according to the present invention.
Figure 5:
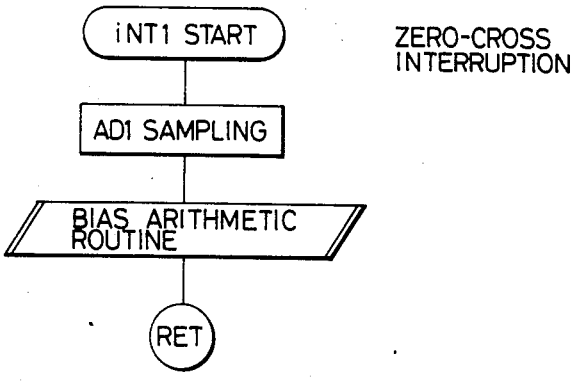
FIG. 5 is a flow chart showing an interruption routine.
Figure 6:
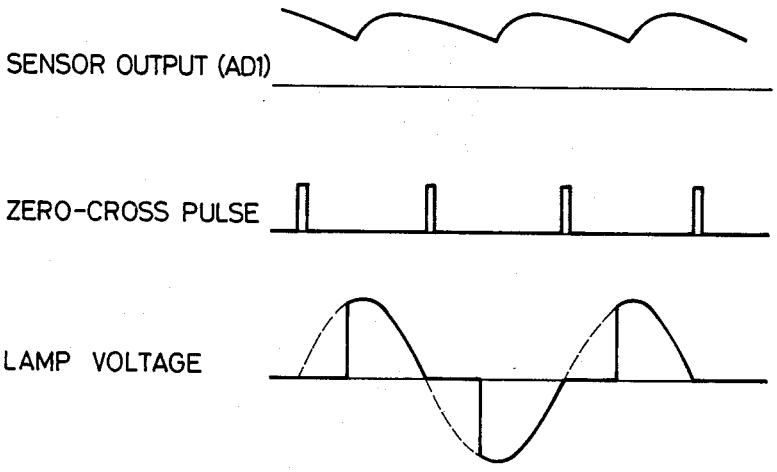
FIG. 6 is a wave form chart showing signals in various parts of the circuit according to the present invention.

FIG. 4 shows a circuit for detecting the original image density, in which a detection current from a photodiode 1, corresponding the photosensor 121, in converted into a voltage by an operational amplifier 2, and then is subjected to a gain control is an operational amplifier 3 for supply to a one-chip microcomputer 7 incorporating an A/D converter. In response to the input level at AD1 and input signals from variable resistors 5,6, said microcomputer 7 releases pulsewidth modulated (PWM) pulses through an output port 01 for determining the developing bias DC voltage supplied to the developing unit 112, and said pulses are subjected to a level conversion through an integrator to obtain a developing bias control signal for supply to a high-voltage transformer 8. The variable resistor 5 determines the developing bias DC voltage in response to the change in sensitivity of the Photosensitive drum 108, for a predetermined reference density (a standard density in the present embodiment) of the original. On the other hand, the variable resistor 6 determines the variable range of the developing bias DC voltage corresponding to a second reference density determined separately from first-mentioned reference density. A tansformer 9 performs full-wave rectification of the secondary side and an operational amplifier 11 performs zero-cross detection. The obtained zero-cross pulse is supplied to an interruption port INT1 of the microcomputer 7 to execute an interruption routine for sampling the signal at AD1 as shown in FIG. 5. As the wave form at AD1 varies with a repeating period equal to a half cycle of the power supply voltage, in synchronization with the lighting voltage of the exposure lamp LA1 as shown in FIG. 6, the sampling at the zero-cross point is effective for obtaining correct data. Switches 14, 15 select the intensity of the exposure lamp in four levels, and a corresponding lighting voltage control signal is supplied, after conversion into an analog signal in a D/A converter 16, to a lamp regulator LR1. An output port 02 releases a lamp lighting signal through an inverter 17.

Figure 7:
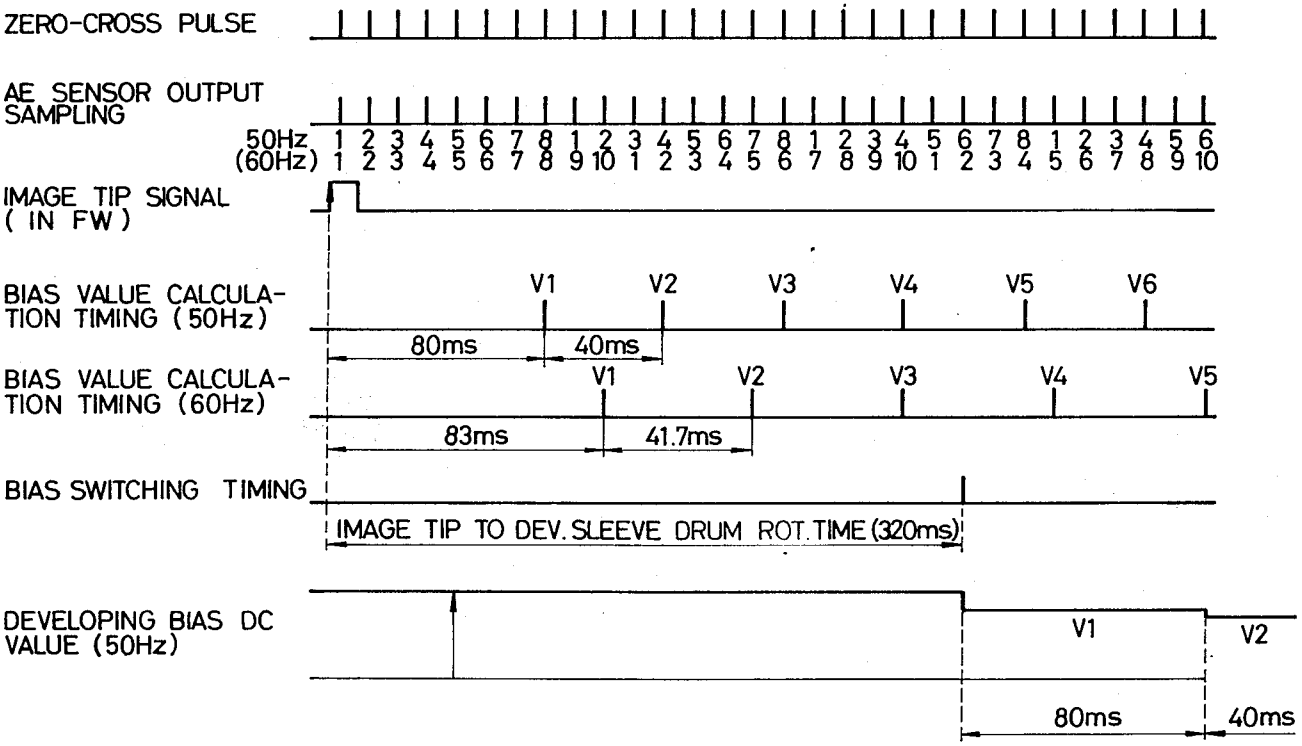
FIG. 7 is a timing chart showing the function of the present invention.
Figure 8:
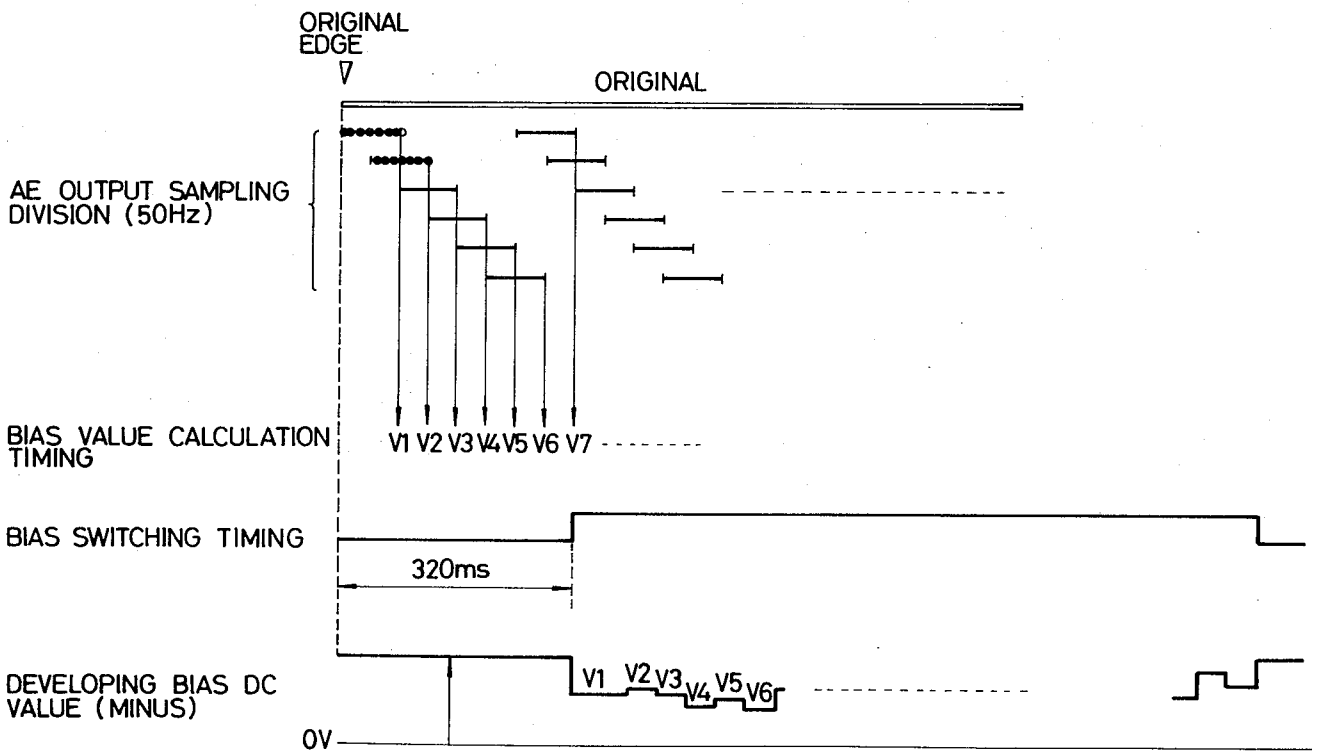
FIG. 8 is a chart showing the relationship between the sampling operation on the output of an automatic exposure control sensor and the developing bias DC voltage.
Figure 9:
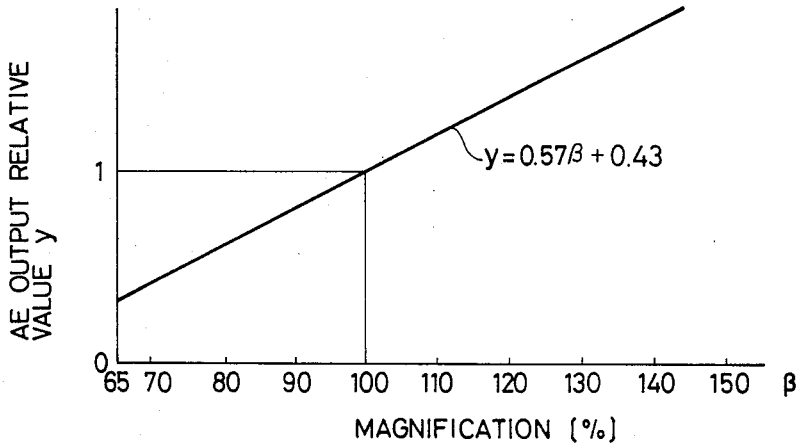
FIG. 9 is a chart showing the relationship between the copy magnification and the output of the automatic exposure control sensor.

FIG. 7 is a timing chart showing the automatic density control function or automatic exposure control function according to the present invention. The copying machine embodying the present invention is equipped with a zoom lens 106 as shown in FIG. 3, for achieving continuous variable image magnification with a step of every 1% for image reduction or enlargement, so that the relationship between the image magnification and the sensor output at AD1 for an original of a given density is represented by a one-order equation as shown in FIG, 9. Consequently the sensor output at AD1 obtained by sampling has to be corrected, as will be explained later, to a value corresponding to a same-size copying by the one-order equation shown in FIG. 9, according to the image magnification of the copy. Now referring to FIG. 7, the automatic exposure control function according to the present embodiment is effected in a cascade control process, wherein the light reflected from the original is detected by the photosensor 1 of which output is sampled at the zero-cross point, and the developing bias voltage is controlled by a developing bias signal to be calculated from the thus sampled data. At first, after the entry of an image front end signal from the image front end sensor 119 in the course of the forward motion of the original support table, a first developing bias value V1 is calculated from the outputs of the photosensor sampled at first 8 or 10 zero-cross points respectively for a power supply frequency of 50 or 60 Hz. A next sampling section is started at the 5th or 6th zero-cross point, respectively for a power supply frequency of 50 or 60 Hz, in the first sampling section as shown in FIG. 8, and a next developing bias DC voltage V2 is calculated at the 8th or 10th zero-cross point. Subsequent developing bias voltages V3, V4, . . . are calculated by repeating similar control.

Each developing bias DC voltage Vn thus determined is released at a bias switching timing, in an order starting from V1, as shown in FIG. 8. Said bias switching timing is defined, from the entry of the image front end signal, by the laps of 320 msec, obtained by dividing the distance 32 mm between the exposure position A on the photosensitive drum and the developing sleeve by the process speed of 100 mm/sec.

As will be apparent from the foregoing explanation, in the automatic exposure cascade control of the present embodiment, the developing bias voltage Vn for developing a latent image area is determined in response to the original image density of a corresponding area of the original and of a preceding area thereof. Stated differently, in the present automatic exposure control, the developing bias voltage is controlled at a particular time interval (40 msec for 50 Hz or 41.5 msec for 60 Hz) in such a manner that the image density does not show a drastic change at a boundary where the bias voltage is switched from Vn to Vn+1.

Figure 10:
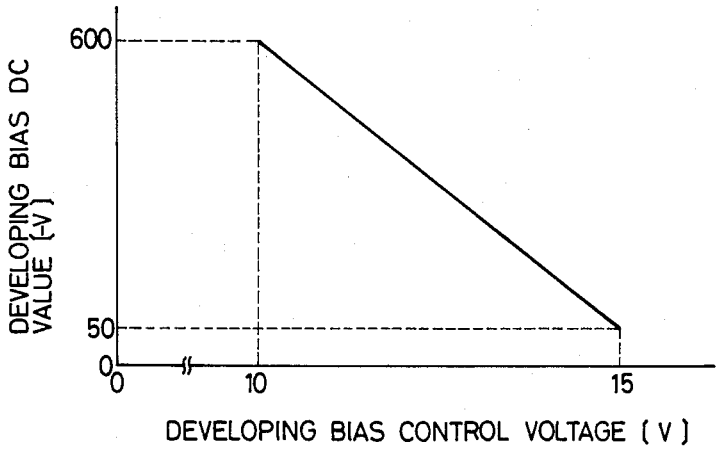
FIG. 10 is a chart showing the behavior of the developing bias DC voltage of a high-voltage transformer.
Figure 11:
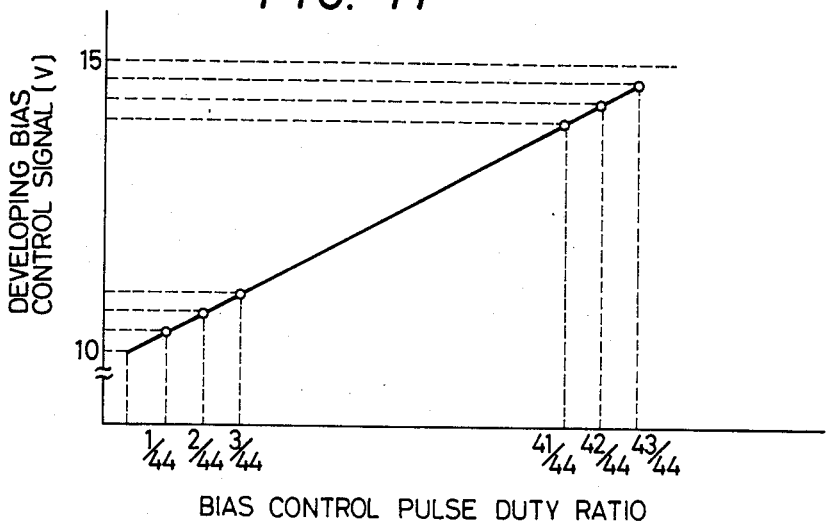
FIG. 11 is a chart showing the relationship between developing bias control pulse and developing bias control signal.

In the following there will be explained the method of calculating the developing bias DC voltage Vn, executed in a zero-cross interruption routine shown in FIG. 5. The high-voltage transformer 8 employed in the present embodiment has a linear control characteristic from −50 to −600 V in response to a control signal from 10 to 15V, as shown in FIG. 10. Said control signal is obtained, in the present embodiment, by level conversion in an integrator of the pulse-width modulated pulses released from the output port 01 as shown in FIG. 4. This is more specifically shown in FIG. 11. In the present embodiment, the duty ratio of the pulse is varied in 43 levels for controlling the control signal for the developing bias DC voltage, so that the resloving power of the developing bias DC voltage is given by:

$$(600-50)/44 = 12.5 \text{ V}.$$

In this manner an optimum image density is obtained by releasing, in succession from the output port 01, pulses of a duty ratio corresponding to the developing bias voltage calculated by the routine shown in FIG. 5.

Figure 12:
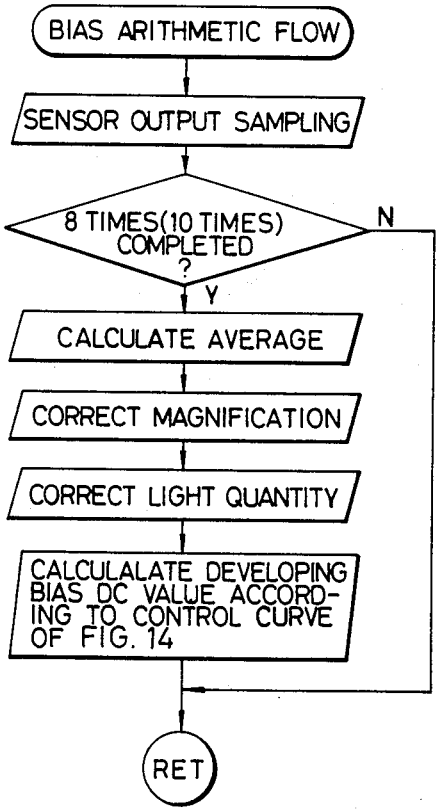
FIG. 12 is a flow chart for bias calculation in automatic exposure control mode.

FIG. 12 shows the details of the bias calculating routine shown in FIG. 5. After the original in the forward motion passes the image front end sensor, an average value is calculated over 8 or 10 sample out-puts respectively in case of a power supply frequency of 50 or 60Hz , and is corrected to a value corresponding to an equal-size image by the one-order equation representing the image magnification, as already explained in relation to FIG. 9. More specifically, in the correction for magnification shown in FIG. 12, the value Vn for an image magnification of 100% is obtained from the aforementioned average value $v_n$ for an image magnification of x % according to the following equation:

$$Vn = \bar{v}_n/(0.57\beta + 0.43)$$

$$= \bar{v}_n/\left(0.57 \times \frac{x}{100} + 0.43\right).$$

Figure 15:
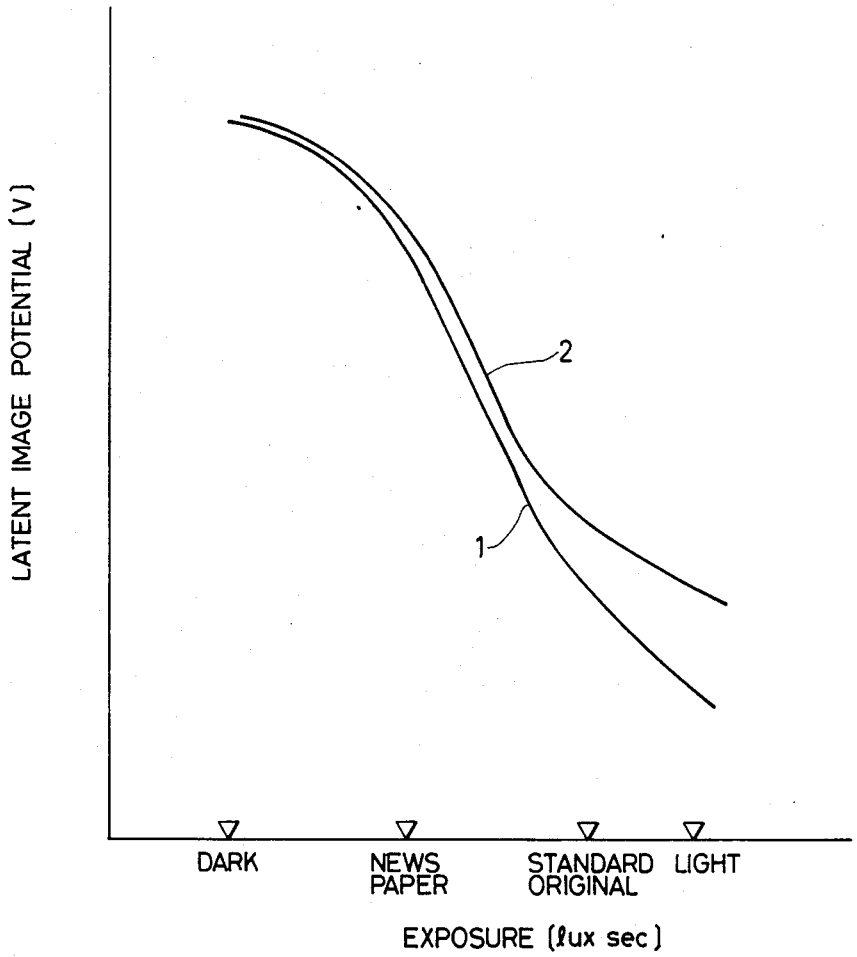
FIG. 15 is a chart showing the time-dependent change in sensitivity of a photosensitive drum.

Subsequently there is executed a correction for light quantity. The photosensitive drum utilizing an organic photoconductor, employed in the present embodiment shows a tendency of a gradual increase in the light potential and a gradual loss of contrast with the repetition of imaging cycles as shown in FIG. 15. In order to compensate such tendency, the quantity of light from the exposure halogen lamp is selected by the switches 14, 15 as shown in FIG. 4. More specifically, when the light potential of the photosensitive drum becomes higher after the repetition of imaging cycles, the lighting voltage of the exposure halogen lamp is increased to compensate the loss in contrast. Said lighting voltage can be varied in four levels by the combination of the switches 14, 15 shown in FIG. 4. The microcomputer 7 transmits an 8-bit signal to the D/A converter 16 in response to said combination, and said D/A converter converts said signal into an analog value which is supplied as the control signal to the lamp regulator LR1. Thus, in said correction for light quantity, a corrected value $v_n$ is obtained from the value $v_n$ after correction for image magnification, according to the following equation:

$$v_n' = v_n \times \frac{E0}{El}$$

wherein E0 is a standard lighting voltage, and El is another lighting voltage E1, E2 or E3.

The above-explained correction is required because of a fact that the image density of the original is detected by the quantity of light reflected therefrom. Stated differently, a change in the lighting voltage of the exposure lamp leads to a change in the quantity of reflected light, thus giving rise to a change in the detected image density. It is therefore necessary to convert the detected image density into the density at the standard lighting voltage.

Figure 13:
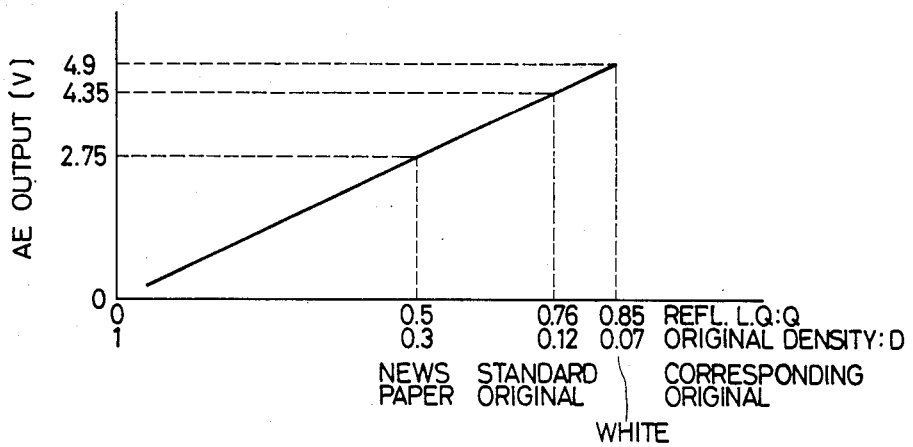
FIG. 13 is a chart showing the relationship between the amount Q of light reflected from the original and the output of the automatic exposure control sensor.
Figure 14:
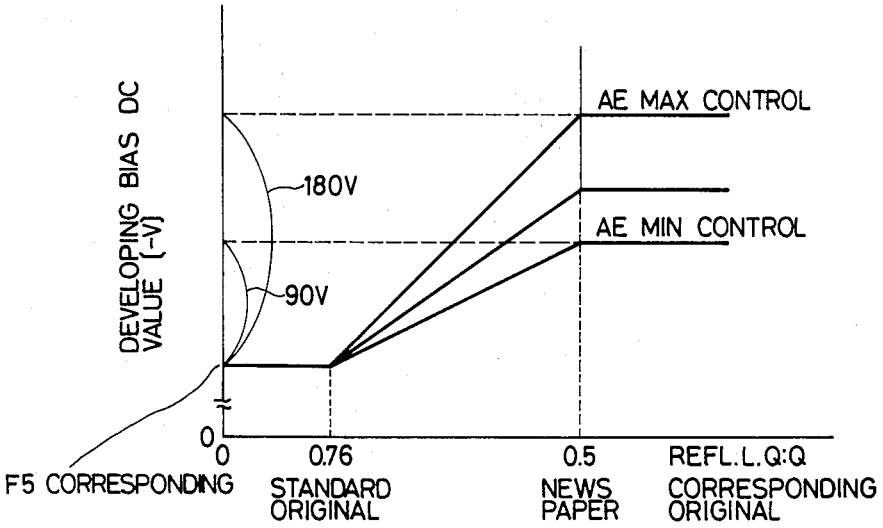
FIG. 14 is a chart showing the relationship between the amount Q of light reflected from the original and the developing bias DC voltage.

The original image density is thus determined, as shown in FIG. 13, by the above-explained correction for light quantity, and there is then executed the final step in FIG. 12, i.e. the calculation of the developing bias DC voltage corresponding to the corrected value $v_n$, as will be explained in the following in relation to FIG. 14. A linear control of the developing bias DC voltage for a density range from an original with the standard density of a reflectance Q=0.76 to a dark-background original with a reflectance Q=0.5 corresponding to newspaper allows image reproduction without background smudge for a dark original and with clear images for a light original. On the other hand, excessively light or dark background is avoided by defining an upper limit in the developing bias voltage for an original darker than newspaper and a lower limit for an original lighter than standard original density. As the photosensitive drum 108 of the present embodiment employing an organic photoconductor has a tendency to increase the latent image potential for a determined amount of exposure from a curve 1 to 2 in FIG. 15 with the repetition of copying cycles, the developing bias control value for the standard original, or the aforementioned lower limit, has also to be rendered variable as shown in FIG. 14, and such variable control is realized by the variable resistor 5 shown in FIG. 4. In addition, since the time-dependent change of the photosensitive drum shown in FIG. 15 gives rise to a decrease in the contrast between the light potential $V_L$ and the dark potential $V_D$, it is necessary to vary the variable range of the developing bias control between an original of the standard density and an original corresponding to newspaper, according to the lapse of time. In the present embodiment, said variable range is varied from a minimum of 90 V to a maximum of 180 V by means of the variable resistor 6 shown in FIG. 4.

In this manner the present embodiment allows optimum image reproduction in response to the density of the original, with image control capable of even following the density change in an original, by means of successive control within an original. Thus an efficient copying function is achieved by avoiding the waste of copy sheets.

There is already known a copying machine in which plural process means therein are integrally combined as a cartridge detachable from the copying machine. In such copying machine, said cartridge may be provided with signal generating means for compensating the possible fluctuation in the sensitivity resulting at the preparation of the photosensitive member.

Figure 16:
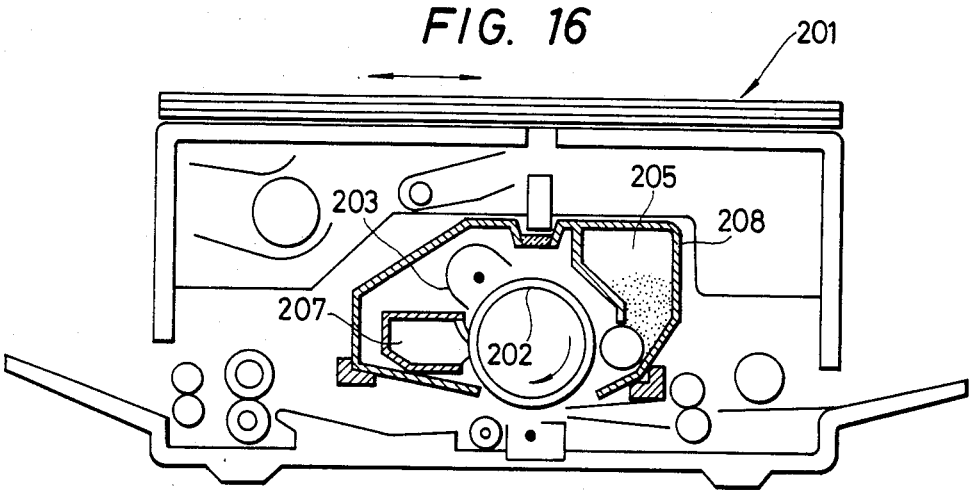
FIG. 16 is a cross-sectional view of a copying machine with a detachable cartridge.

FIG. 16 is a cross-sectional view of a copying machine 201 employing such cartridge, which, in this embodiment, incorporates a photosensitive drum 202, a charger 203, a developing unit 205 and a cleaner 207 and is rendered detachable from the main body.

Figure 17:
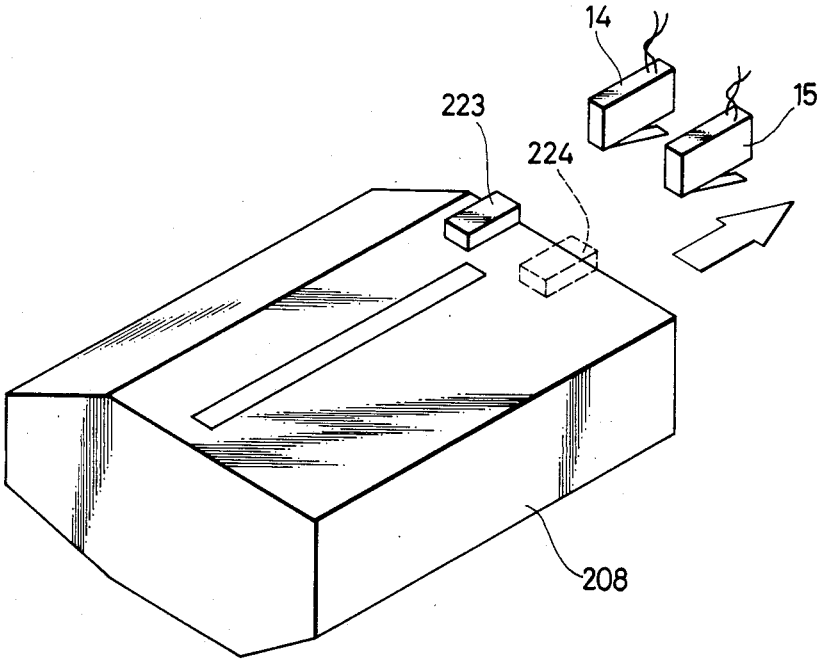
FIG. 17 is a perspective view of the cartridge.

FIG. 17 is an enlarged view of a cartridge which is provided with suitable projections 223, 224 which represent the sensitivity of the photosensitive drum and actuate the switches 14, 15 shown in FIG. 4, whereby the lamp lighting voltage is so controlled as to compensate the possible fluctuation in the sensitivity resulting at the preparation of the photosensitive drum.

It is also possible to select a suitable characteristic curve for the photosensitive member by the combination of said projections and switches.

Although the foregoing embodiment has been limited to a copying machine in which the original support table is movable, the present invention is likewise applicable to a copying machine in which the optical system is movable, or a copying apparatus in which originals are continuously moved in one direction.

Also in the foregoing embodiment the automatic exposure control is conducted on real-time basis, but the present invention is also applicable to a system in which a preliminary scanning is effected in order to measure the density of the original image in advance.

We claim:

1. An image forming apparatus comprising:

image forming means for forming an image corresponding to an original onto a recording member, said image forming means including exposure means for exposing the original;

detecting means for detecting the image density of the original by receiving light from the original;

regulating means capable of setting the quantity of exposure of said exposure means to a plurality of levels; and control means for controlling an operative condition of said image forming means in accordance with an output of said detecting means so as to form a suitable density of image, wherein said control means is adapted to correct the operative condition of said image forming means in accordance with the level of the light quantity set by said regulating means.

2. An image forming apparatus according to claim 1, wherein said image forming means comprises plural process means, in which the process means is regulated by said regulating means.

3. An image forming apparatus according to claim 2, wherein each of said plural process means includes developing means for developing an electrostatic latent image formed on said recording member.

4. An image forming apparatus according to claim 3, wherein said regulating means is adapted to regulate the lighting voltage of said exposure means.

5. An image forming apparatus according to claim 3, wherein said control means is adapted to control the developing bias voltage to be supplied to said developing means.

6. An image forming apparatus according to claim 1, wherein said detecting means is adapted to detect the image density in response to the quantity of light coming from said original.

7. An image forming apparatus according to claim 4, wherein said regulating means comprises switch means for stepwise selecting the lighting voltage of said exposure means.

8. An image forming apparatus according to claim 5, wherein said control means is adapted to determine the operative condition of said image forming means for an area of said original, in consideration also of the image density in areas in front of and behind the first-mentioned area.

9. An image forming apparatus according to claim 8, wherein the operative condition of said image forming means is the developing bias voltage.

10. An image forming apparatus comprising:

image forming means for forming an image corresponding to an original onto a recording member;

detecting mcans for detecting the image density of the original by means of receiving light from the original; and control means for controlling an operative condition of said image forming means in accordance with an output of said detecting means, wherein said control means is operable to obtain a correction value by means of performing arithmetic operation on the output of said detecting means, and to determine the operative condition of said image forming means in accordance with data obtained by means of performing addition or subtraction of said correction value to a predetermined reference value.

11. An image forming apparatus according to claim 10, wherein said image forming means comprises latent image forming means for forming an electrostatic latent image on said recording member and developing means for developing said electrostatic latent image.

12. An image forming apparatus according to claim 11, wherein said control means is adapted to control the developing bias voltage to be supplied to said developing means.

13. An image forming apparatus according to claim 10, wherein said control means is adapted to effect addition or subtraction of said correction value to or from said reference value.

14. An image forming apparatus comprising:

image forming means for forming an image corresponding to an original onto a recording member, said image forming means including exposure means for exposing the original;

detecting means for detecting image density of the original by means of receiving light from the original;

power source means for applying a voltage, which changes with a predetermined period, to said exposure means;

output means for outputting a signal synchronized with said voltage supplied from said power source means; and control means for performing sampling of an output of said detecting means in accordance with said synchronizing signal and for controlling an operative condition of said image forming means in accordance with the obtained sampling value.

15. An image forming apparatus according to claim 14, wherein the voltage from said power source means is AC voltage, and the signal from said output means is a signal synchronized with a zero-cross of said AC voltage.

16. An image forming apparatus according to claim 14, wherein said image forming means includes latent image forming means for forming an electrostatic latent image on said recording member and developing means for developing the electrostatic latent image on said recording member, said control means controls an operative condition of said developing means.

17. An image forming apparatus according to claim 16, wherein said operative condition is a developing bias voltage.

18. An image forming apparatus according to claim 14, wherein said control means controls the operative condition of said image forming means, while said image forming means is performing the image forming operation.

* * * * *